United States Patent [19]

Mansson et al.

[11] 4,095,418

[45] Jun. 20, 1978

[54] FUEL FLUSHING FROM INJECTOR FOR COMBUSTION CHAMBER

[75] Inventors: Martin Mansson; Ragnar Torstenfelt, both of Finspong, Sweden

[73] Assignee: Stal-Laval Turbin AB, Finspong, Sweden

[21] Appl. No.: 733,986

[22] Filed: Oct. 20, 1976

[30] Foreign Application Priority Data

Oct. 28, 1975 Sweden ..... 7512016

[51] Int. Cl.[2] ..... F02C 7/22; F02G 3/00; F23D 11/30

[52] U.S. Cl. ..... 60/39.09 F; 431/121; 239/124

[58] Field of Search ..... 60/39.09 F, 39.74 R, 60/39.09 R; 261/DIG. 21; 239/124, 125, 126; 417/118; 123/139 DP; 431/121, 29

[56] References Cited

U.S. PATENT DOCUMENTS

| | | | |
|---|---|---|---|
| 749,563 | 1/1904 | Johnson et al. | 417/118 |
| 2,116,337 | 5/1938 | Broeze et al. | 60/39.74 R |
| 2,578,934 | 12/1951 | Janssen | 239/126 |
| 2,595,566 | 5/1952 | Caret | 60/39.74 R |
| 2,701,164 | 2/1955 | Purchas et al. | 60/39.74 B |

*Primary Examiner*—Carlton R. Croyle
*Assistant Examiner*—Thomas I. Ross
*Attorney, Agent, or Firm*—Pollock, Vande Sande & Priddy

[57] ABSTRACT

Apparatus for the injection of fuel into a gas turbine which is adapted to remove the fuel from the injectors when the turbine is to be stopped. Each injector provides separate, parallel fuel flow paths from a pair of fuel inlet connections toward a plurality of atomizing apertures. When the turbine is to be stopped, one of the inlet connections is connected to a source of compressed air and the other is connected to a sump for the fuel.

3 Claims, 4 Drawing Figures

FUEL FLUSHING FROM INJECTOR FOR COMBUSTION CHAMBER

BACKGROUND OF THE INVENTION

In the operation of a gas turbine, it is desirable that the fuel present in the injectors be removed upon a sudden stop of the turbine. If the fuel were to be allowed to remain in the injectors, it would crack, i.e., form solid products, because of the high temperature present, and this would of course impair the operation of the injectors once the turbine is again started. One way of alleviating this problem is to inject the fuel in the injectors into the combustion chamber; however, this is not considered to be a desirable solution to the problem, since such injection of the fuel supplies considerable additional energy to the turbine which may cause it to overspeed. A further possible solution is to blow the oil out of the injectors into a drainage tank by means of compressed air, and the present invention is based upon this principle.

The concept of air injection in order to blow the fuel out of the injectors is known in the art and has been used in the past on injectors having a movable needle which acts as a stop valve and which is effective to close the injector nozzle when it is desired to stop the turbine, whereafter compressed air can be supplied to the injectors for cleaning. This principle is not, however, applicable to injectors that do not have a movable needle.

OBJECTS OF THE INVENTION

It is an object of this invention to provide apparatus for the removal of fuel from gas turbine injectors when the turbine is to be stopped which utilizes the concept of blowing the oil out of the injectors by compressed air, but with the apparatus being particularly suitable for use in injectors that do not have a movable needle or stop valve. The apparatus of the invention makes it possible to clean injectors rapidly by the blowing of air into the injectors, but accomplishes this without releasing more than at most minimal amounts of oil into the combustion chamber when the turbine is stopped.

BRIEF DESCRIPTION OF THE DRAWINGS

In describing the invention, reference will be made to the accompanying drawings in which.

DETAILED DESCRIPTION OF THE PREFERRED EMBODIMENT

Figure 1:
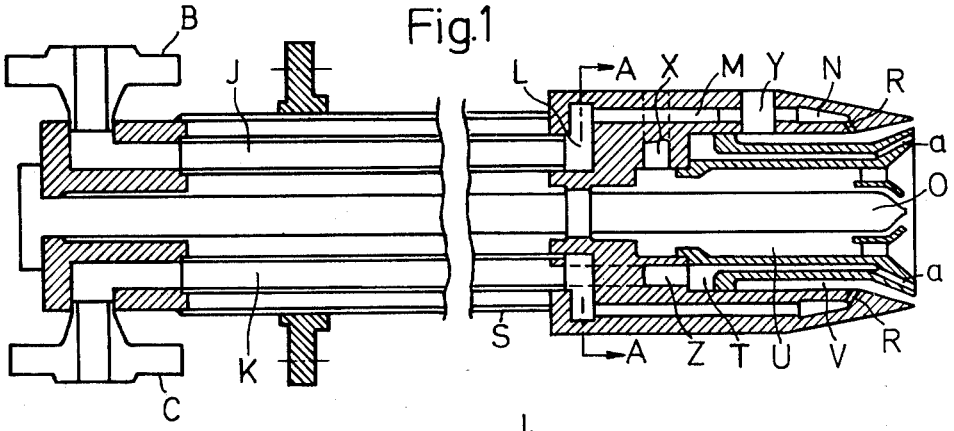
FIG. 1 is a longitudinal cross-sectional view through the injector of the present invention.
Figure 2:
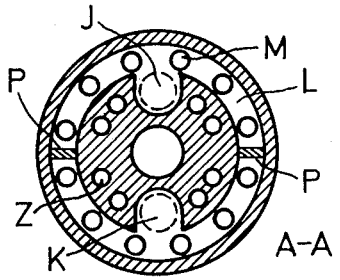
FIG. 2 is a cross-sectional view taken along section line A—A of the injector of FIG. 1.

FIG. 1 illustrates in cross-sectional view the injector of the present invention, and the left-hand part of the injector is shown as having two connecting flanges B and C which communicate with an annular channel L through tubes J and K. The channel L is divided into two equal halves by a partition wall P as particularly shown in the cross-sectional view of FIG. 2. The annular channel L, in turn, communicates, through a number of axially extending holes M, with a further annular channel N from which various atomizing holes R emanate.

The fuel flow from the two separate flanges B and C is conducted to the annular channel N over two separate parallel flow paths. One of these flow paths includes the connecting flange B, tube J, one-half of the annular channel L, the through holes M associated with the relevant half of the channel L, to the common annular channel N. The other flow path, correspondingly, includes connecting flange C, tube K, the other half of annular channel L, the holes M which extend from such other half of channel L, to the common annular channel N.

When the turbine is to be shut down, one branch of the two parallel flow paths is connected to compressed air, and the other to a drainage sump, thereby making it possible to blow the entire injector clean all the way to and through the annular channel N which forms a common connection for the two paraellel fuel flow paths. As a result, only a small part of the fuel located in the narrow annular channel N and the atomizing holes R will be blown out into the combustion chamber. This amount of fuel is so slight, however, that the additional energy imparted to the turbine is incapable of resulting in an overspeed condition.

Figure 3:
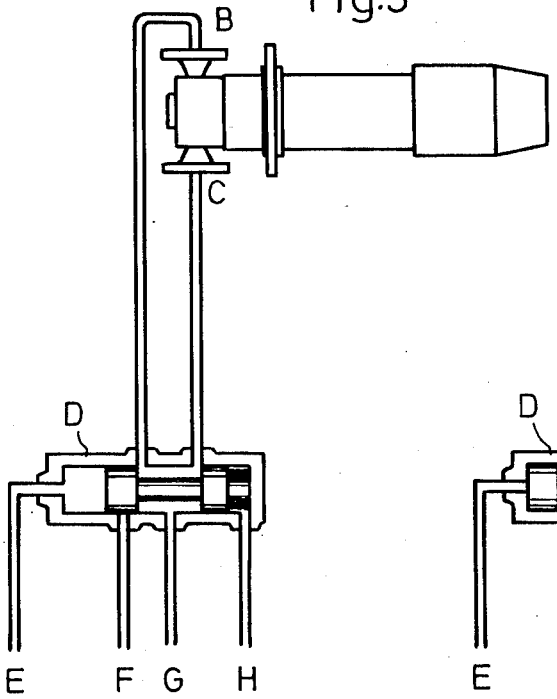
FIG. 3 is a schematic drawing showing the manner of use of the injector of the present invention where the injector is in its operating condition.
Figure 4:
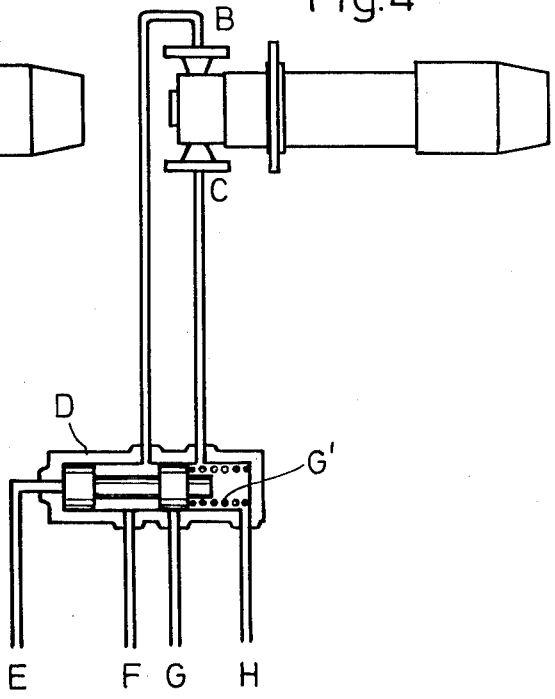
FIG. 4 is a schematic drawing corresponding generally to FIG. 3 but showing the apparatus conditioned for the stopping of the turbine and the blowing-out of the oil remaining in the injectors.

To effect the appropriate control of the injectors, each injector is connected to a pilot valve D as shown diagrammatically in FIGS. 3 and 4. In the operating position of the apparatus as shown in FIG. 3, operating air is switched into the connection E so that the slide valve is urged to its right-hand position as shown. As a result, the air connection F, by which air can be selectively applied to blow out the injectors, is then blocked, but it can be seen that a connection is provided under these circumstances from the main fuel connection G so as to supply fuel to both of the connecting flanges B and C so that fuel is then supplied over both of the parallel fuel flow paths to the turbine. When the turbine is to be stopped, the operating air connection E is evacuated, and the slide is then urged by spring G' to the left as shown in FIG. 4 so that the main fuel inflow G is blocked and, at the same time, cleaning air for the injectors from the inlet F is now able to reach the injector flange B. The resultant flow of air causes the fuel in the injector now to be forced out of the injector and into a fuel sump (not shown) through flange C and connection H.

The pressure of the cleaning air supplied through connection F is preferably adjusted so that it is somewhat higher than the pressure in the combustion chamber of the turbine, with the result that a small amount of fuel in the injector will necessarily be fed into the combustion chamber through the atomizing holes R until such time as the cleaning air reaches these atomizing holes, whereafter only air will be blown into the combustion chamber. However, since all of the inlets B, C, J, K, and L are of substantial cross-section relative to the small atomizing holes R, the amount of fuel which is admitted into the combustion chamber will be quite small.

FIG. 1 illustrates an auxiliary injector O at the middle of the injector, and the function of such auxiliary injector is to aid in the start of the injector. Thus, air is supplied to the annular spaces U and V at the right-hand part of the injector through bores X and Y. When operating with a gaseous fuel, this is conducted through the mantle S and the holes Z to the space T and the injector holes *a*.

What we claim is:

1. Apparatus for the injection of fuel into a gas turbine combustion chamber comprising:

an injector defining separate first and second parallel fuel flow paths from separate fuel inlet connections toward a plurality of atomizing apertures defined in said injector, means for simultaneously supplying the fuel from a fuel source to both said inlet connections during normal operation of said turbine, and for connecting one said inlet connection to a source of compressed air while concurrently said other inlet connection is connected to a fuel sump, during shutdown for purposes of cleaning said injector.

2. The apparatus of claim 1 wherein the cross-sectional arrangement of each of the first and second fuel flow paths is substantially greater than that of the cumlative cross-sectional area of the atomizing apertures.

3. The apparatus of claim 1, further including valve means operable between two distinctive conditions in response to a signal, said valve means in its first condition opening a fuel flow path from a fuel source to both said fuel inlet connections on said injector, said valve means in its second condition blocking communication from said fuel source to both said inlet connections and instead connecting one said inlet connection to an air pressure source and the other said inlet connection to a fuel sump.

* * * * *